US011475823B2

(12) United States Patent
Kimmel et al.

(10) Patent No.: US 11,475,823 B2
(45) Date of Patent: Oct. 18, 2022

(54) SELECTIVELY CONTROLLING TRANSPARENCY STATES OF PIXELS OF A DISPLAY

(71) Applicant: Nokia Technologies Oy, Espoo (FI)

(72) Inventors: Jyrki Sakari Kimmel, Tampere (FI); Marja Salmimaa, Tampere (FI); Toni Jarvenpaa, Akaa (FI)

(73) Assignee: Nokia Technologies Oy, Espoo (FI)

( * ) Notice: Subject to any disclaimer, the term of this patent is extended or adjusted under 35 U.S.C. 154(b) by 0 days.

(21) Appl. No.: 16/977,685

(22) PCT Filed: Mar. 20, 2018

(86) PCT No.: PCT/FI2018/050203
§ 371 (c)(1),
(2) Date: Sep. 2, 2020

(87) PCT Pub. No.: WO2019/180298
PCT Pub. Date: Sep. 26, 2019

(65) Prior Publication Data

US 2020/0394949 A1 Dec. 17, 2020

(51) Int. Cl.
*G09G 3/00* (2006.01)
*G09G 3/20* (2006.01)

(52) U.S. Cl.
CPC ..... *G09G 3/2085* (2013.01); *G09G 2300/023* (2013.01); *G09G 2300/0469* (2013.01); *G09G 2300/0842* (2013.01); *G09G 2380/10* (2013.01)

(58) Field of Classification Search
None
See application file for complete search history.

(56) References Cited

U.S. PATENT DOCUMENTS 5,945,972 A * 8/1999 Okumura ..... G09G 3/3659 345/98
9,827,835 B2 * 11/2017 El Idrissi ..... B60J 3/04
2015/0029218 A1 * 1/2015 Williams ..... G06T 19/006 345/633
2016/0357014 A1 * 12/2016 Beckman ..... B60J 3/04

FOREIGN PATENT DOCUMENTS

JP 2001-228818 8/2001

* cited by examiner

*Primary Examiner* — Michael A Faragalla
(74) *Attorney, Agent, or Firm* — Harrington & Smith

(57) ABSTRACT

An apparatus has a display including a plurality of pixels; and control circuitry configured to selectively control transparency states of the plurality of pixels of the display. The control circuitry includes a multiplicity of cells. A transparency state of one or more pixels is controlled by a state of an associated cell. A cell is configured to provide a propagation signal dependent upon a state of that cell to physically adjacent cells and is configured to receive propagation signals provided by physically adjacent cells. The state of the cell is controllable via addressing and is controllable via the received propagation signals.

19 Claims, 6 Drawing Sheets

SELECTIVELY CONTROLLING TRANSPARENCY STATES OF PIXELS OF A DISPLAY

CROSS REFERENCE TO RELATED APPLICATION

This patent application is a U.S. National Stage application of International Patent Application Number PCT/FI2018/050203 filed Mar. 20, 2018, which is hereby incorporated by reference in its entirety.

TECHNOLOGICAL FIELD

This document describes selectively controlling transparency states of pixels of a display.

BACKGROUND

A display comprises a plurality of picture elements (pixels).

BRIEF SUMMARY

According to various, but not necessarily all, embodiments of the invention there is provided an apparatus comprising:

a display comprising a plurality of pixels; and control circuitry configured to selectively control transparency states of the plurality of pixels of the display, the control circuitry comprising a multiplicity of cells wherein a transparency state of one or more pixels is controlled by a state of an associated cell, wherein a cell is configured to provide a propagation signal dependent upon a state of that cell to physically adjacent cells and is configured to receive propagation signals provided by physically adjacent cells, wherein the state of the cell is controllable via addressing and is controllable via the received propagation signals.

In some but not necessarily all examples, the control circuitry is configured such that if a defined combination of adjacent cells to a subject cell all have a first state then the subject cell has a first state, wherein the control circuitry is configured such that the first state of the subject cell causes an opaque state of one or more pixels.

In some but not necessarily all examples, the control circuitry is configured such that if any of a defined combination of adjacent cells to a subject cell have a second state then the subject cell has a second state unless the state of the cell is controlled via addressing to be a first state, wherein the control circuitry is configured such that the second state of the subject cell causes a transparent state of one or more pixels.

In some but not necessarily all examples, the control circuitry is configured such that when a subject cell is controlled via addressing to be a first state, the subject cell causes an opaque state of one or more pixels.

In some but not necessarily all examples, the multiplicity of cells are configured to provide respective propagation signals in electrical parallel.

In some but not necessarily all examples, a cell comprises circuitry for logically combining received propagation signals from different cells.

In some but not necessarily all examples, the cells are arranged in an array of rows and columns, wherein at least some cells comprise circuitry for logically combining a received propagation signal from a cell in a nearest neighbour row at the same column with a received propagation signal from a cell in a nearest neighbour column at the same row to provide an output propagation signal for a cell in a different nearest neighbour row and the same column and for a cell in a different nearest neighbour column and the same row.

In some but not necessarily all examples, a cell comprises a memory component configured to store a state of the cell for controlling a transparency state of one or more pixels. In some but not necessarily all examples, the control circuitry is configured to address the memory component to store a state of the cell.

In some but not necessarily all examples, the control circuitry is configured to address the memory component using a combination of a voltage state on a row line and a voltage state on a column line, wherein a first combination of high voltage and low voltage on the row line and the column line causes a first state to be written to the memory component and a second different combination of high voltage and low voltage on the row line and the column line causes a second state to be written to the memory component. In some but not necessarily all examples, the control circuitry is configured such that the stored value in the memory component is controllable via the received propagation signals. In some but not necessarily all examples, the control circuitry is configured such the stored value in the memory component determines a propagation signal provided to physically adjacent cells.

In some but not necessarily all examples, a cell comprises a memory component configured to store a state of the cell for controlling a transparency state of one or more pixels associated with the cell, wherein the control circuitry is configured to control a stored value of a memory component of each of a selected first set of cells and wherein the control circuitry is configured to apply the stored values of the memory components of at least the selected first set of cells to associated pixels, simultaneously in parallel.

In some but not necessarily all examples, the control circuitry is configured to define a boundary by setting a state of selected cells via addressing and is configured to in-fill the boundary via the propagation signals.

In some but not necessarily all examples, the apparatus additionally comprises a content display, wherein the display at least partially overlies the content display and is configured to operate as a transparency controlled display.

In some but not necessarily all examples, the apparatus additionally comprises a see-through display wherein the display at least partially overlies the see-through display and is configured to selectively control see-through transparency in dependence upon content displayed by the see-through display.

In some but not necessarily all examples, the apparatus is comprised in a system comprising the apparatus and a chassis configured to support the apparatus in use as part of a display, wherein the system is a wearable display and the chassis is a wearable chassis configured to enable the apparatus to be worn by a user, the system is a vehicle and the chassis is a vehicular chassis configured to enable the apparatus to be part of the vehicle, the system is an appliance and the chassis is an appliance chassis configured to enable the apparatus to be part of the appliance, the system is a building and the chassis is a building chassis configured to enable the apparatus to be part of the building, or the system is a free-standing display and the chassis is a support chassis configured to enable the apparatus to be supported by the ground.

According to various, but not necessarily all, embodiments of the invention there is provided an apparatus comprising:

a see-through display comprising a plurality of pixels wherein a transparency state of a pixel is controlled by a state of an associated cell controllable via addressing and received cell-to-cell propagation signals.

In some but not necessarily all examples, each associated cell is configured to have a first state that causes an opaque state of one or more pixels only if the state of that cell is controlled via addressing to be the first state or a defined combination of adjacent cells to that cell all have a first state.

According to various, but not necessarily all, embodiments of the invention there is provided a method comprising:

controlling a state of a first set of cells by addressing those cells;

controlling a state of a second set of cells by cell-to-cell transfer of propagation signals;

using the state of the first set of cells and the second set of cells to control a transparency state of pixels in a see-through display.

In some but not necessarily all examples, each cell is configured to have a first state that causes an opaque state of one or more pixels only if the state of that cell is controlled via addressing to be the first state or a defined combination of adjacent cells to that cell all have a first state.

According to various, but not necessarily all, embodiments of the invention there is provided an apparatus comprising means for:

controlling a state of a first set of cells by addressing those cells;

controlling a state of a second set of cells by cell-to-cell transfer of propagation signals;

using the state of the first set of cells and the second set of cells to control a transparency state of pixels in a see-through display.

In some but not necessarily all examples, each cell is configured to have a first state that causes an opaque state of one or more pixels only if the state of that cell is controlled via addressing to be the first state or a defined combination of adjacent cells to that cell all have a first state.

According to various, but not necessarily all, embodiments of the invention there is provided examples as claimed in the appended claims.

BRIEF DESCRIPTION

For a better understanding of various examples that are useful for understanding the detailed description, reference will now be made by way of example only to the accompanying drawings in which.

DETAILED DESCRIPTION

Figure 1:
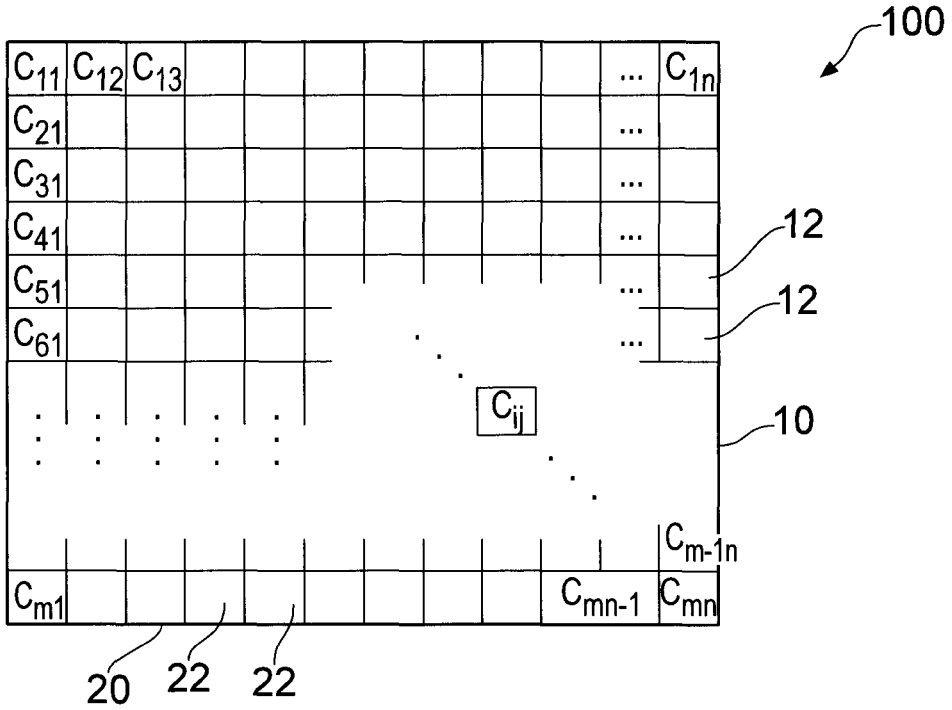
FIG. 1 illustrates an example of an apparatus comprising cells and pixels.

FIG. 1 illustrates an example of an apparatus 100. The apparatus 100 comprises a display 10.

A display is an apparatus that controls what is perceived visually (viewed) by the user. The display 10 may be a visual display that selectively provides light to a user. Examples of visual displays include liquid crystal displays, direct retina projection display, near eye displays etc. The display may be a head-mounted display (HMD), a hand-portable display or television display or some other display In some but not necessarily all examples, the display 10 is a see-through display. A see-through display is a display that operates as a window when all of its pixels 12 are transparent. A user can see-through the display to a scene beyond the window. In augmented reality the scene beyond may be a real-world scene.

In some but not necessarily all examples, the display is a liquid crystal display or some other display in which transparency of the display can be controlled on a pixel basis.

Figure 3A:
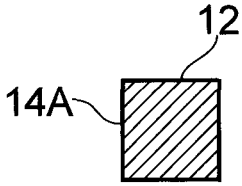
FIG. 3A illustrates an example of a pixel that has an opaque transparency state and FIG. 3B illustrates an example of a pixel that has a transparent transparency state.
Figure 3B:
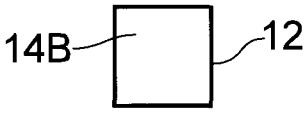

In some but not necessarily all examples, the display 10 is a multi-state display, for example a two-state display. Each pixel of the display 10 has a transparency state 14 that can be either an opaque state 14A or a transparent state 14B (see FIGS. 3A, 3B). When a pixel 12 has a transparent state 14B, light passes through the pixel 12 and when a pixel has an opaque state 14A, the pixel is less transparent and less light passes through the pixel 12. The transparent state 14B may be but is not necessarily completely transparent and it is more transparent than the opaque state 14A. The opaque state 14A may be but is not necessarily completely opaque and it is less transparent than the transparent state 14B.

The apparatus 10 also comprises control circuitry 20 configured to selectively control transparency states 14 of the plurality of pixels 12 of the display 10.

The control circuitry 20 is logically divided into a multiplicity of cells 22. Each cell 22 is associated with a sub-set of one or more pixels 12. Each sub-set of pixels 12 is distinct in that it does not overlap with any other sub-set of pixels. Consequently a pixel 12 is associated with one cell 22. In the examples described below, the sub-set consists of one pixel, that is there is a one-to-one mapping between a cell 22 and a pixel 12. However, in these and other examples, the sub-set may comprise more than one pixel 12.

The transparency state of the sub-set of pixels 12 is controlled by a state of the associated cell 22.

A cell 22 is configured to provide a propagation signal 30 dependent upon the state of that cell 22 to physically adjacent cells 22 and is configured to receive propagation signals 30 provided by physically adjacent cells 22.

Figure 2:
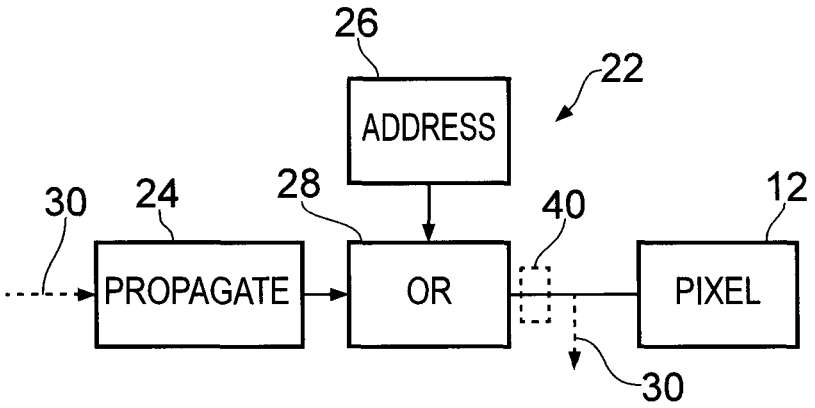
FIG. 2 illustrates an example of a cell controlling a pixel.

As illustrated in FIG. 2, a state of the cell 22 is controllable 26 via addressing the cell 22 and is controllable 24 via the received propagation signals 30.

The cell 22 has a first state that causes an opaque state 14A of one or more pixels 12 if the state of that cell 22 is controlled via addressing to be the first state OR a defined combination of propagation signals 30 is received.

If a subject cell 22 is controlled via addressing to be a first state, that cell 22 has a first state.

If the subject cell 22 is controlled via addressing to be a second state, that cell 22 conditionally has a second state that causes a transparent state of the one or more associated pixels 12, in the absence of receiving the defined combination of propagation signals 30. That is, if the subject cell 22 is controlled via addressing to be a second state then the subject cell 22 has a second state unless the state of the cell 22 is controlled via the received defined combination of propagation signals 30 to be a first state.

In one example, the defined combination of propagation signals 30 indicates that a defined combination of adjacent cells 22 to that cell 22 all have a first state. Thus, if a defined combination of adjacent cells 22 to a subject cell 22 all have a first state then the subject cell 22 has a first state that causes an opaque state 14A of the associated one or more pixels 12. If any of the defined combination of adjacent cells 22 to the subject cell 22 have a second state then the subject cell 22 has a second state unless the state of the cell 22 is controlled via addressing to be a first state.

When the cell 22 has a first state it causes an opaque state 14A of the one or more associated pixels 12. When the cell 22 has a second state it causes a transparent state of the one or more associated pixels 12.

The state of the cell 22 is provided as the output propagation signal 30. The cells 22 provide respective propagation signals 30 in electrical parallel.

Optionally the state of the cell 22 may be stored in a physical memory component 40. Each cell 22 comprises a physical memory component 40 configured to store a state of the cell 22 for controlling a transparency state of the one or more pixels 12 associated with the cell 22.

The memory component 40 can be a dynamic memory component 40 or a static memory component 40. For example, the memory component can be a capacitor or capacitance, a dynamic random access memory, a static random access memory, a latch, a flip-flop, a field programmable gate array.

The memory component 40 is addressed by the control circuitry to store a value that records the state of the cell. The stored value in the memory component 40 is also controllable via the received propagation signals 30. The control circuitry 20 is configured so that a stored value in the memory component 40 determines the propagation signal 30 provided to physically adjacent cells 22.

Figure 4:
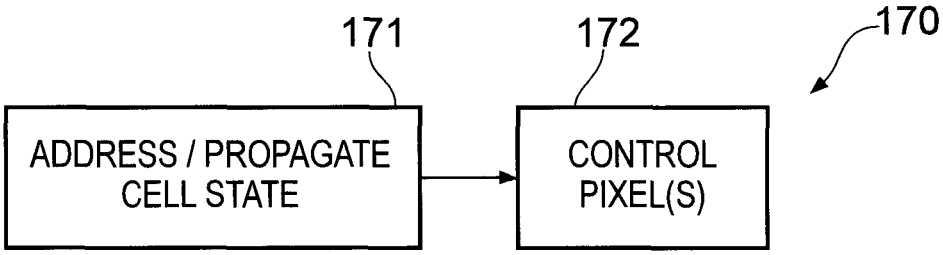
FIG. 4 illustrates an example of a method.

As illustrated in the method 170 of FIG. 4, the use of memory components 40 enables a two-stage process of writing to the display pixels 22.

At block 171, the first stage, cell states are recorded for each cell in the memory components 40 of the cells 22. Then at block 172, the second stage, the cell state of each cell is written to the one or more display pixels 12 associated with that cell. The writing can occur in parallel. The states of the cells 22 are flashed to the display pixels 12.

The first stage-recording cell states for each cell in the memory components of the cells 22 also uses parallelism. Block 171 may, for example comprise: controlling states of a first set of cells 22 by addressing those cells 22; and controlling states of a second set of cells 22 by cell-to-cell 22 transfer of propagation signals 30. The cells 22 provide the propagation signals 30 in electrical parallel. As will be described in more detail below, in some examples, the first set of cells 22 define a boundary and then the second set of cells will lie within the boundary.

The state of the first set of cells 22 and the second set of cells 22 is used in the second stage to control a transparency state of pixels 12 in the display 10.

In some examples therefore a cell 22 comprises a memory component 40 configured to store a state of the cell 22 for controlling a transparency state of one or more pixels 12 associated with the cell. The control circuitry 20 is configured to control a stored value of a memory component 40 of each of a selected set of cells 22. The control circuitry 20 is configured to apply the stored values of the memory components 40 of at least the selected set of cells 22 to associated pixels 12, simultaneously in parallel to all pixels.

Figure 5:
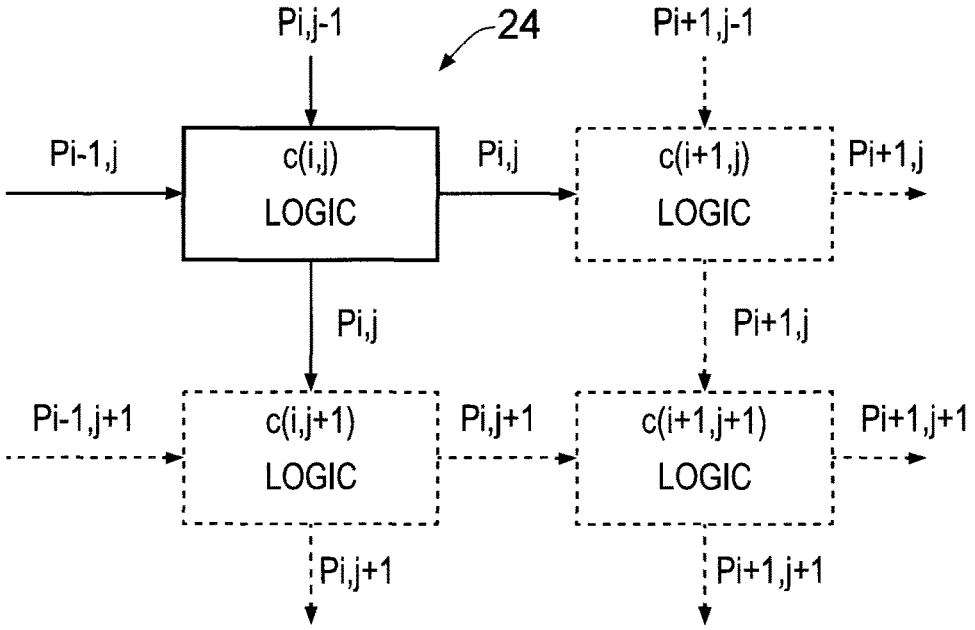
FIG. 5 illustrates an example of cell-to-cell propagation.

FIG. 5 illustrates an example of cell-to-cell 22 transfer of propagation signals 30. A cell 22 is configured to provide a propagation signal 30 dependent upon the state of that cell 22 to physically adjacent cells 22 and is configured to receive propagation signals 30 provided by physically adjacent cells 22.

Let cell c(i, j) represent a cell in an regular array of cells 22 that is positioned in the ith row and the jth column, where i=1, 2, 3 . . . m and j=1, 2, 3 . . . n.

Each cell c(i, j), for i=1, 2, 3 . . . m−1 and j=1, 2, 3 . . . n−1, produces an output propagation signal 30 labelled $p_{i,j}$ that is provided as an input propagation signal 30 to cell c(i+1, j) and to cell c(i, j+1). The cell c(i, j) receives an input propagation signal $p_{i-1,j}$ and an input propagation signal $p_{i,j-1}$. The propagation signal $p_{i-1,j}$ is from cell c(i−1, j). The propagation signal $p_{i,j-1}$ is from cell c(i, j−1). Each of the cells 22 comprises circuitry 24 for logically combining the received input propagation signals 30 from different cells 22.

Figure 6:
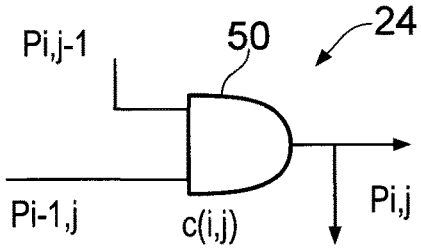
FIG. 6 illustrates an example of an AND gate.

FIG. 6 illustrates an example of circuitry 24. An AND logic gate 50 performs the logical AND operation at cell c(i, j) on an input propagation signal and an input propagation signal $p_{i,j-1}$ to produce the output propagation signal $p_{i,j}$.

If the input propagation signal $p_{i-1,j}$ indicates that cell c(i−1, j) has a first state and the input propagation signal $p_{i-1,j}$ indicates that cell c(i−1, j) has a first state, then the cell c(i, j) will have a first state and this will be indicated in the output propagation signal $p_{i,j}$.

If the input propagation signal $p_{i-1,j}$ indicates that cell c(i−1, j) has a second state or the input propagation signal indicates that cell c(i, j−1) has a second state, then the cell c(i, j) will have a second state and this will be indicated in the output propagation signal $p_{i,j}$ It will therefore be appreciated that the first state can propagate through the array of cells 22 in parallel via the propagation signals 30 produced in electrical parallel.

Whereas in the illustrated example, propagation is from c(i, j) to c(i+1,j) and c(i, j+1) based on the output condition $p_{i-1,j}$ AND $p_{i,j-1}$ other examples are possible such as:
propagation is from c(i, j) to c(i+1, j) and c(i, j−1) based on the output condition $p_{i-1,j}$ AND $p_{i,j+1}$;
propagation is from c(i, j) to c(i−1, j) and c(i, j+1) based on the output condition $p_{i+1,j}$ AND $p_{i,j-1}$;
propagation is from c(i, j) to c(i−1, j) and c(i, j−1) based on the output condition $p_{i+1,j}$ AND $p_{i,j+1}$.

Whereas in the illustrated example, propagation is from one cell c(i, j) to two cells c(i+1,j) and c(i, j+1) with the output condition $p_{i-1,j}$ AND $p_{i,j-1}$ other examples are possible such as: propagation from one cell c(i, j) to two cells c(i+1,j) and c(i+1, j+1) with the output condition $p_{i-1,j}$ AND $p_{i-1,j-1}$.

In general propagation is from one cell c(i, j) to two cells c(i+$\alpha_1$, j+$\beta_1$) and c(i+$\alpha_2$, j+$\beta_2$) with the output condition $p_{i-\alpha1,j-\beta1}$ AND $p_{i-\alpha2,j-\beta2}$.

Thus when the cells 22 are arranged in a regular array of rows and columns, at least some cells 22 comprise circuitry for logically combining a received propagation signal 30 from a cell 22 in a nearest neighbour row at the same column and a received propagation signal 30 from a cell 22 in a nearest neighbour column at the same row to provide an output propagation signal 30 for a cell 22 in a different nearest neighbour row and same column and for a cell 22 in a different nearest neighbour column and the same row.

Figure 7:
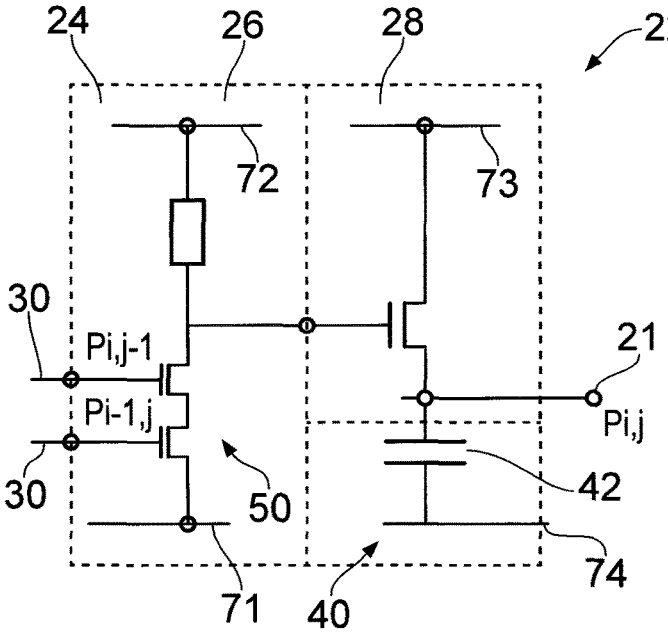
FIG. 7 illustrates an example of a cell.

FIG. 7 illustrates an example of a cell 22 as illustrated in FIG. 2.

The cell c(i,j) comprises AND gate 50 that performs the logical AND operation at cell c(i, j) on the input propagation signals 30 ($p_{i-1,j}$ and $p_{i,j-1}$). The signal line 71 is logic 1, the signal line 72 is logic 0, the signal line 73 is logic 1, the signal line 74 is logic 0.

The output from the AND gate 50, the propagation signal $p_{i,j}$, is provided to the gate 28 which is coupled to the memory component 40 (capacitor 42). If both the input propagation signals 30 ($p_{i-1,j}$ and $p_{i,j-1}$) indicate a first state (logic 1), the output from the AND gate 50, the propagation signal indicates a first state (logic 1) from signal line 71. This passes through the gate 28 and a value (logic 1) representing the first state, from signal line 73, is recorded in the memory component 40 (capacitor 42). The value (logic 1) representing the first state recorded in the memory component 40 (capacitor 42) is provided as the output propagation signal $p_{i,j}$ of the cell c(i, j) at output node 21.

The cell c(i,j) is addressed using the signal line 72 and the signal line 73 in a manner similar to a DRAM memory cell. When signal line 72 is logic 1 and signal line 73 is logic 1, then logic 1 is recorded in the memory component 40 (capacitor 42). When signal line 72 is logic 1 and signal line 73 is logic 0, then logic 0 is recorded in the memory component 40 (capacitor 42). The signal line 74 is logic 0.

Addressing can be achieved in other ways. For example, the resistor between signal line 72 and the input to the gate 28 may be replaced with a transistor switch.

For example an ADDR line (not illustrated) may connect to a gate of a transistor switch connected between the signal line 73 and the output node 21 of the cell 22. ADDR provides a logic 1 while signal line 73 is logic 1 and signal line 74 is logic 0 to write logic 1 to the memory component 40. ADDR provides a logic 1 while signal line 73 is logic 0 and signal line 74 is logic 1 to write logic 0 to the memory component 40.

For example an ADDR line (not illustrated) may connect to a gate of a transistor switch connected between the signal line 74 and the output node 21 of the cell 22. ADDR provides a logic 1 while signal line 73 is logic 1 and signal line 74 is logic 0 to write logic 0 to the memory component 40. ADDR provides a logic 1 while signal line 73 is logic 0 and signal line 74 is logic 1 to write logic 1 to the memory component 40.

Thus the control circuitry 20 is configured to address the memory component 40 using a combination of a voltage state on a row line and a voltage state on a column line, wherein at least a first combination of high voltage and low voltage on the row line and the column line causes a first state to be written to the memory component 40 and at least a second different combination of high voltage and low voltage on the row line and the column line causes a second state to be written to the memory component 40.

Thus the control circuitry 20 is configured such that the stored value in the memory component 40 is controllable via the received propagation signals 30.

The control circuitry 20 is configured such the stored value in the memory component 40 determines a propagation signal 30 provided to physically adjacent cells 22.

During the addressing phase:
signal line 71 is logic 1
signal line 72 is logic 1/0
signal line 73 is logic 1
signal line 74 is logic 0

During the propagation phase:
signal line 71 is logic 1 (no change)
signal line 72 is logic 0 (change)
signal line 73 is logic 1 (no change)
signal line 74 is logic 0 (no change)

The signal line 71 and signal line 73 can therefore be the same signal line.

The signal line 71 and signal line 73 can therefore be a ROW signal line.

The signal line 72 can therefore be an ADDR signal line.

The signal line 74 can therefore be a COM signal line.

Figure 8:
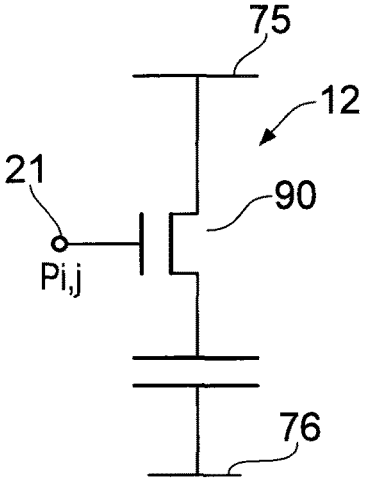
FIG. 8 illustrates an example of a pixel.

FIG. 8 illustrates an example of a pixel 12. In this example, the pixel 12 is a pixel of an LCD display 20.

The cell 22 c(i,j) provides the output propagation signal $p_{i,j}$ to control a switch for addressing the pixel 12. In this example, the output propagation signal $p_{i,j}$ is provided to a gate electrode of a transistor switch 90 that completes the electric circuit from the signal line 75 to the signal line 76 through the pixel 12.

During a pixel-write phase of writing to the pixels 12, the signal line 75 is logic 1 and the signal line 76 is logic 0. When the output propagation signal $p_{i,j}$ has a logic 1 state, the switch is open and the pixel 12 state becomes logic 1 (opaque).

Subsequently the pixel 12 can be reset, by addressing a first state (logic 1) to the associated cell 22 and setting the signal line 75 to logic 0 and the signal line 76 to logic 1.

The memory component 40 may also be reset at this time by setting the signal line 73 to logic 0 and the signal line 74 to logic 1.

The transistors used in the transistor switches, logic circuitry and logic gates may be thin film transistors (TFTs). Some or all of them may be oxide based TFTs, for example indium-gallium-zinc oxides (IGZO) TFTs or other low leakage transistors.

Figure 9:
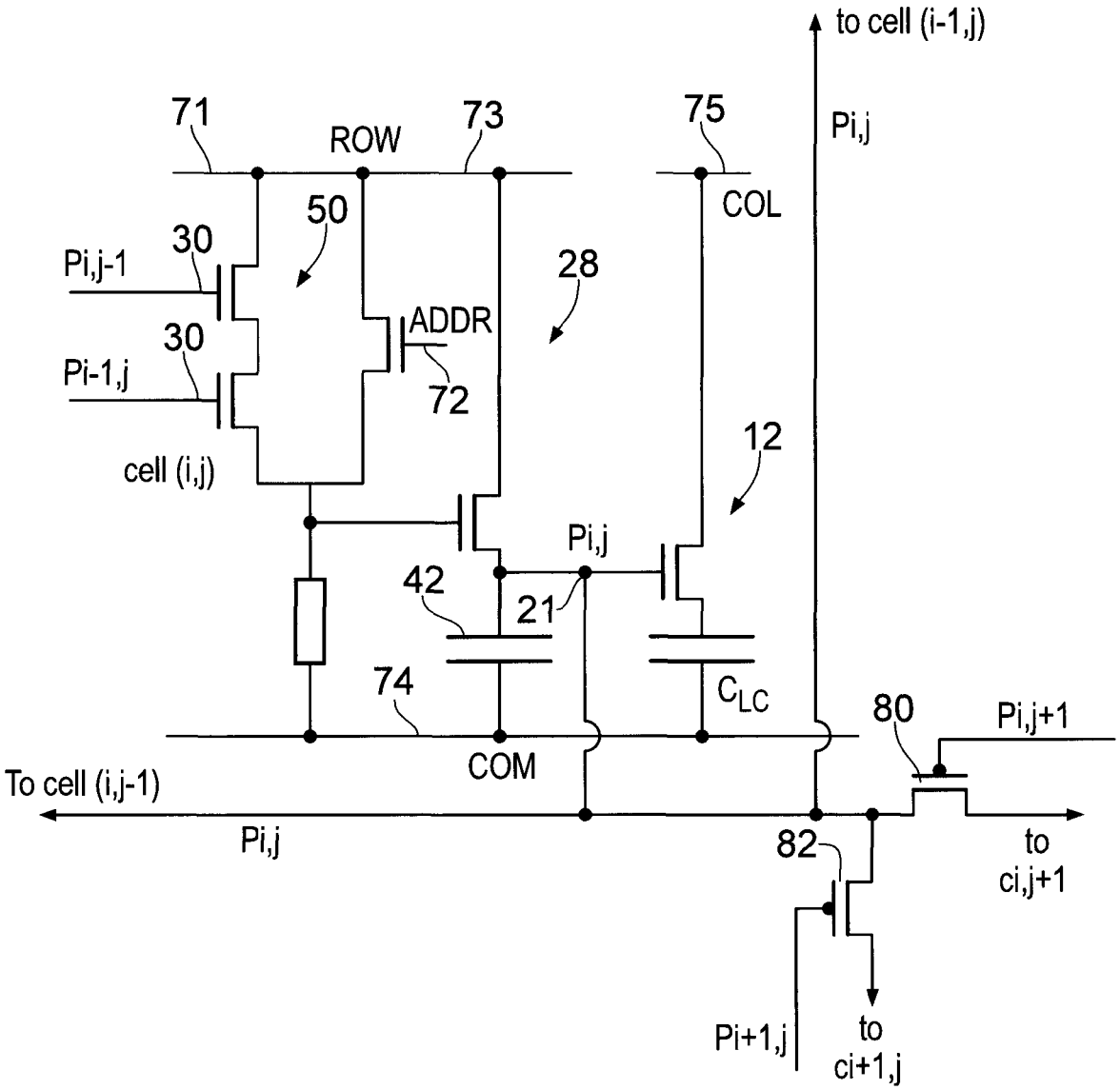
FIG. 9 illustrates an example of a cell and a pixel.

FIG. 9 illustrates an example of a cell 22 as illustrated in FIG. 2 and FIG. 7.

The signal line 71 and signal line 73 can be the same signal line. The signal line 71 and signal line 73 can be a ROW signal line. The signal line 72 can be an ADDR signal line. The signal line 74 can be a COM signal line. The signal line 75 can be a COL signal line.

The cell c(i,j) comprises AND gate 50 that performs the logical AND operation at cell c(i, j) on the input propagation signals 30 ($p_{i-1,j}$ and $p_{i,j-1}$).

The output from the AND gate 50, the propagation signal $p_{i,j}$, is provided to the gate 28 which is coupled to the memory component 40 (capacitor 42) and is provided as the output propagation signal $p_{i,j}$ of the cell c(i, j) at output node 21.

The cell 22 can perform the following operations:
manage received propagation signals 30,
manage a received address signal ADDR,
perform a write to the pixel 12,
perform a reset,
propagate an output propagation signal $p_{i,j}$ of the cell c(i, j) to adjacent cells.

When the signal line 71 (and 73) is logic 1, the signal line 72 is logic 0, and the signal line 74 (and 76) is logic 0, if both the input propagation signals 30 ($p_{i-1,j}$ and $p_{i,j-1}$) indicate a first state (logic 1), the output from the AND gate 50, the propagation signal $p_{i,j-1}$, indicates a first state (logic 1) from the signal line 71. This passes through the gate 28 and a value (logic 1) representing the first state, from signal line 73, is recorded in the memory component 40 (capacitor 42). The value (logic 1) representing the first state recorded in the memory component 40 (capacitor 42) is provided as the output propagation signal $p_{i,j}$ of the cell c(i, j) at output node 21.

When the signal line 71 (and 73) is logic 1, and the signal line 74 (and 76) is logic 0, then the signal line 72 provides an addressing signal ADDR which is either logic 0 or logic 1. The cell c(i,j) is addressed using the signal line 72 and the signal line 71,73 in a manner similar to a DRAM memory cell. When signal line 72 is logic 1 and signal line 71,73 is logic 1, then logic 1 is recorded in the memory component 40 (capacitor 42). When signal line 72 is logic 0, then logic 0 is recorded in the memory component 40 (capacitor 42).

Thus the control circuitry 20 is configured such that the stored value in the memory component 40 is controllable via the received propagation signals 30.

In this example, the ADDR line connects to a gate of a transistor switch connected between the signal line 73 and the gate 28, in other examples the transistor switch may be connected between the signal line 73 and the output node 21 of the cell 22 and a transistor switch of reverse polarity may be connected between the signal line 74 and the output node 21 of the cell 22. While signal line 73 is logic 1 and signal line 74 is logic 0, ADDR provides a logic 1 to connect node 21 to line 73 and write logic 1 to the memory component 40 and ADDR provides a logic 0 to connect node 21 to line 74 and write logic 0 to the memory component 40.

Thus the control circuitry 20 is configured to address the memory component 40 using a combination of a voltage states on different lines, wherein at least a first combination of high voltage and low voltage on the lines causes a first state to be written to the memory component 40 and at least a second different combination of high voltage and low voltage on the lines causes a second state to be written to the memory component 40.

The control circuitry 20 is configured such the stored value in the memory component 40 determines an output propagation signal $p_{i,j}$ of the cell c(i, j) to adjacent cells.

In the example illustrated, the control circuitry 20 is configured to conditionally propagate the output propagation signal $p_{i,j}$ of the cell c(i, j) to the adjacent cells c(i, j+1) and c(i+1, j).

The output propagation signal $p_{i,j}$ of the cell c(i, j) is propagated to the adjacent cell c(i, j+1) if the output propagation signal $p_{i,j+1}$ of the cell c(i, j+1) is logic 0 and is not propagated to the adjacent cell c(i, j+1) if the output propagation signal $p_{i,j+1}$ of the cell c(i, j+1) is logic 1. Propagation is thus stopped if the adjacent cell has already been addressed to have logic 1 as the stored value in the memory component 40 of that cell. The output propagation signal $p_{i,j+1}$ of the cell c(i, j+1) is back-propagated to the transistor switch 80 of cell(i,j) and controls the forward propagation of output propagation signal $p_{i,j}$ of the cell c(i, j) to the cell c(i, j+1).

The output propagation signal $p_{i,j}$ of the cell c(i, j) is propagated to the adjacent cell c(i+1, j) if the output propagation signal $p_{i+1,j}$ of the cell c(i+1, j) is logic 0 and is not propagated to the adjacent cell c(i+1, j) if the output propagation signal $p_{i+1,j}$ of the cell c(i+1, j) is logic 1. Propagation is thus stopped if the adjacent cell has already been addressed to have logic 1 as the stored value in the memory component 40 of that cell. The output propagation signal $p_{i,j}$ of the cell c(i+1, j) is back-propagated to the transistor switch 82 of cell(i,j) and controls the forward propagation of output propagation signal $p_{i,j}$ of the cell c(i, j) to the cell c(i+1, j).

In the example illustrated, the control circuitry 20 of the cell c(i,j) is configured to back-propagate the output propagation signal $p_{i,j}$ of the cell c(i, j) to the adjacent cells c(i, j−1) and c(i−1, j).

Thus the control circuitry 20 is configured such that the stored value in the memory component 40 is controllable via the received propagation signals 30.

The control circuitry 20 is configured such that when the signal line 74 (and 76) is logic 0, and the signal line 75 is logic 1, then if logic 1 is stored in the memory component 40 it is transferred to the LC pixel 12.

The control circuitry 20 is configured such that when the signal line 71 (and 73) is logic 0, the signal line 72 is logic 0, and the signal line 74 (and 76) is logic 1, and the signal line 75 is logic 0 the memory component 40 is reset (capacitor 42 is discharged) and the LC pixel 12 is reset.

| | Address Phase | Forward Propagation Phase | Write Phase/Flash | Reset LC | Reset Mem |
|---|---|---|---|---|---|
| 71, 73 ROW | 1 | 1 | | 0 | 0 |
| 72 ADDR | 1/0 | 0 | | 0 | 0 |
| 74, 76 COM | 0 | 0 | 0 | 1 | 1 |
| 75 COL | 0 | 0 | 1 | 0 | 0 |

Figure 10A:
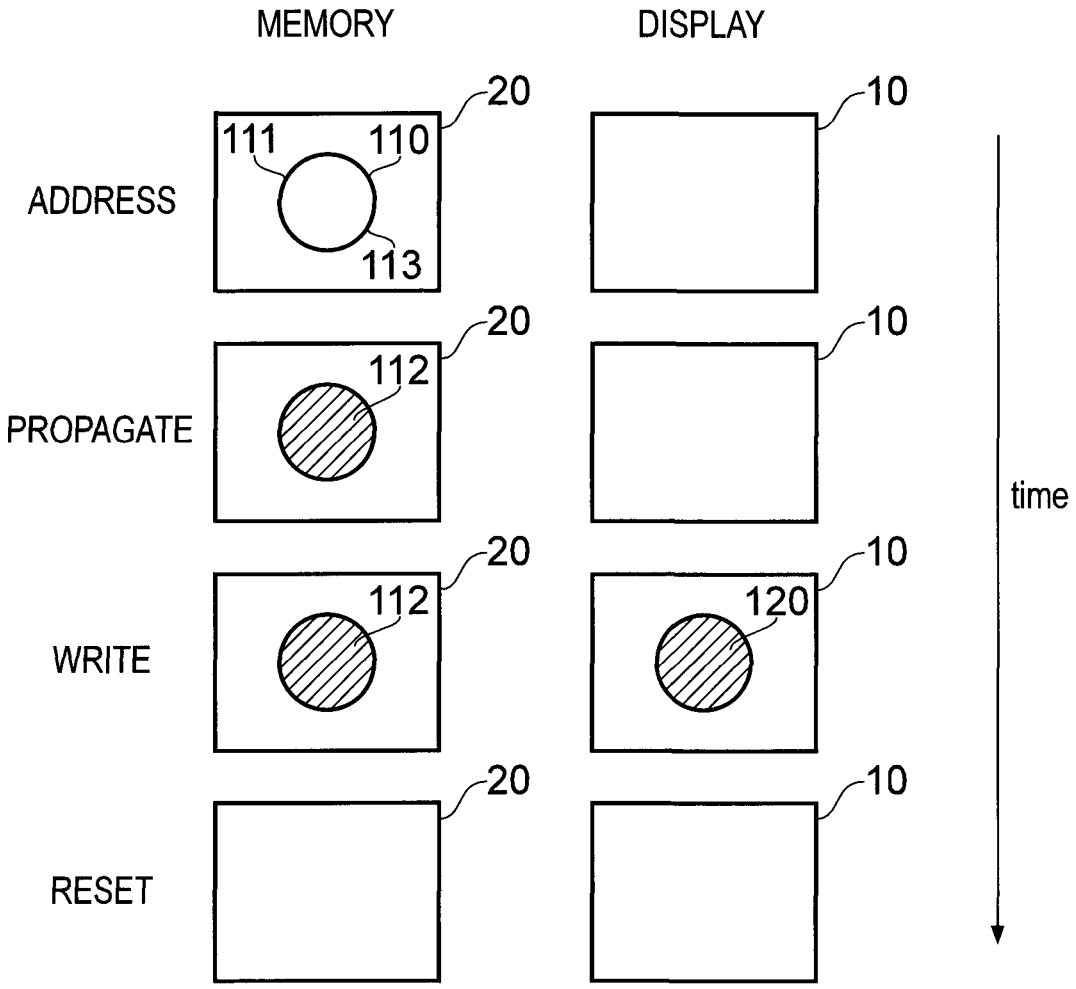
FIG. 10A illustrates an example of phases for changing states of cells and pixels.

FIG. 10A illustrates three phases used to write opaque states 14A to selected pixels 22 of the display 20—the address phase, the propagation phase, and the write phase.

A reset phase is also illustrated which allows the three phases to be used to write opaque states 14A to different selected pixels 22 of the display 20.

Figure 10B:
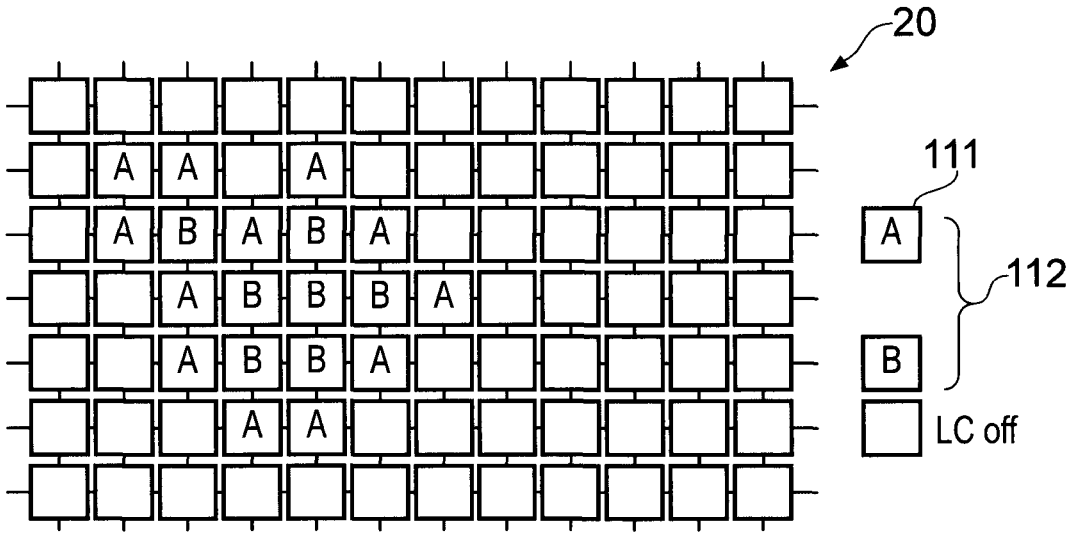
FIG. 10B illustrates an example of propagating states of cells and pixels.

In the address phase, control circuitry 20 is configured to define a boundary 111 by setting a state of selected cells 22 via addressing. In the example of FIG. 9, the boundary 111 is defined by setting a state of selected cells 22 via addressing to logic 1. In the example of FIG. 10B, the boundary 111 is defined by setting a state of selected cells 22 via addressing to a first state A. In this example, the cells 22 in the upper left portion 111 of the boundary, set to the first state are seed cells that initiate propagation of the first state through the other cells 22 (cells labelled B in FIG. 10B) until they are adjacent a cell that is already in the first state.

The control circuitry 20 is configured to in-fill 112 the boundary 111 during the propagation phase by setting the states of the cells 22 within the boundary (labelled B in FIG. 10B) to the first state (logic 1) via cell-to-cell propagation.

The control circuitry 20 is configured to stop forward propagation as a consequence of back propagation from the cells in the boundary 111.

The order of writing to the memory component 20 is important because if a first state (e.g. logic 1) is written it cannot be overwritten by propagation In the example of FIG. 9 this is achieved by terminating forward propagation of the propagation signal.

feedback the state of the next 'downstream' cell to the current cell and stop propagation to that 'downstream' cell However, other approaches may be used. An SR latch could be used to set/reset a third input to the AND gate 50 that enables or disables its operation. It could be set to disable by ADDR logic 0 and reset when the pixel reset occurs.

The control circuitry 20 is configured to write the states of the cells 22 to the associated pixels during the write phase.

The first state (logic 1) in a cell 22 produces an opaque state 14A in the pixels 12 associated with the cell 22. The second state (logic 0) in a cell 22 produces a transparent state in the pixels 12 associated with the cell 22. The pixels 12 that are in the first state (logic 1) collectively form an opaque mask 120. The opaque mask 120 makes a selected portion of the display 10 non see-through (opaque).

The control circuitry 20 is configured to reset the states of the cells 22 to the second state and the states of the associated pixels to the transparent state during the reset phase.

Figure 11A:
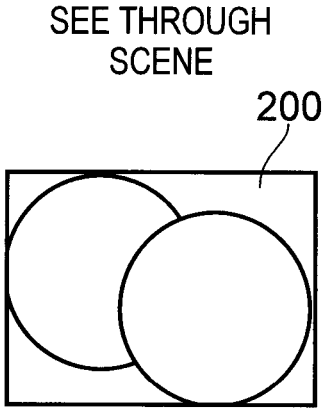
FIG. 11A, 11B, 11C, FIGS. 12A and 12B illustrate an example of operation of the display.
Figure 11B:
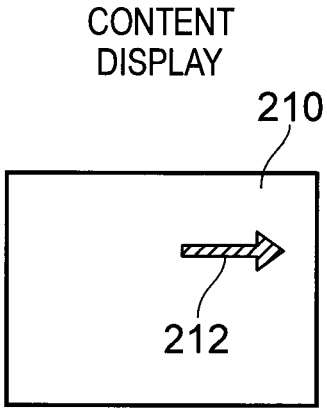
Figure 11C:
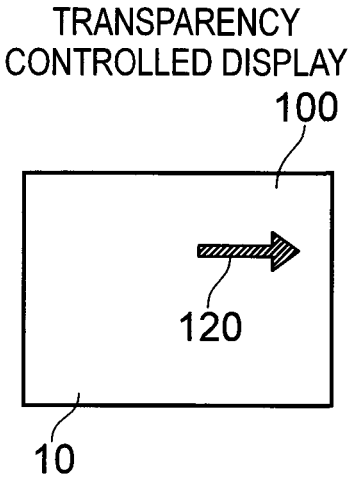

FIG. 11A illustrates a scene 200 seen through a composite display 220 (FIG. 12A) comprising a content display 210 (FIG. 11B) and the apparatus 100 (FIG. 110) in different parallel layers.

Figure 12A:
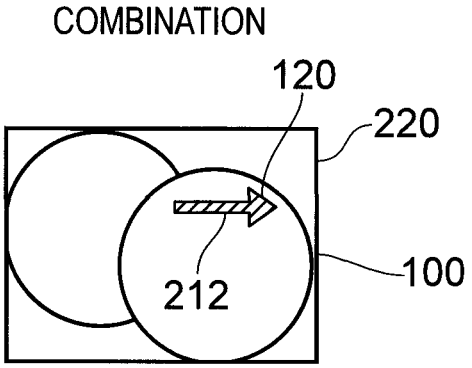

The content display 210 is a see-through display configured to display content 212 that will be positioned in front of the scene 200 (FIG. 12A).

The apparatus 100 comprises a see-through display 10 that provides a controlled opaque mask 120. The opaque mask 120 is created by setting selected pixels 12 of the display 10 to an opaque state 14A as previously described. The opaque mask 120 makes a selected portion of the display 10 non see-through (opaque).

In some but not necessarily all examples, the content display 210 is a transparent whole window sized display, for example an active matrix organic light emitting diode (AMOLED) display or other emissive display that is in front of the see-through display 10.

As illustrated in FIG. 12A, the display 10 at least partially overlies the content display 220 and is configured to provide a mask for content displayed by the content display 220 between the content display 210 and the scene 200. The mask 120, in this example but not necessarily all examples, is sized and shaped so that it corresponds to the content 212 displayed on the content display 212. The mask blocks out light from the scene 200 increasing the visibility of the content 212 as illustrated in FIG. 12A.

Figure 12B:
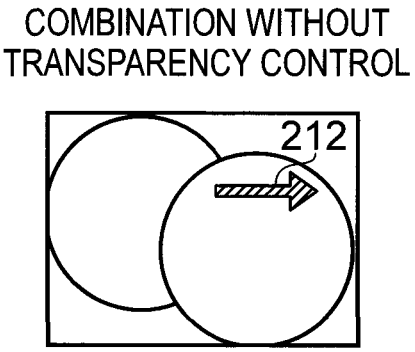

FIG. 12B illustrates the visibility of the content 212 without the opaque mask 120 and FIG. 12A illustrates the visibility of the content 212 with the opaque mask 120. The opaque mask 120 increases contrast.

The apparatus 100 may also comprise the see-through content display 210. The display 10 at least partially overlies the content display 210 and is configured to selectively control see-through transparency in dependence upon content displayed by the content display 210.

A display is an apparatus that controls what is perceived visually (viewed) by the user. The display 10 may be a visual display that selectively provides light to a user. Examples of visual displays include liquid crystal displays, direct retina projection display, near eye displays etc. The display may be a head-mounted display (HMD), a hand-portable display or television display or some other display.

Figure 13A:
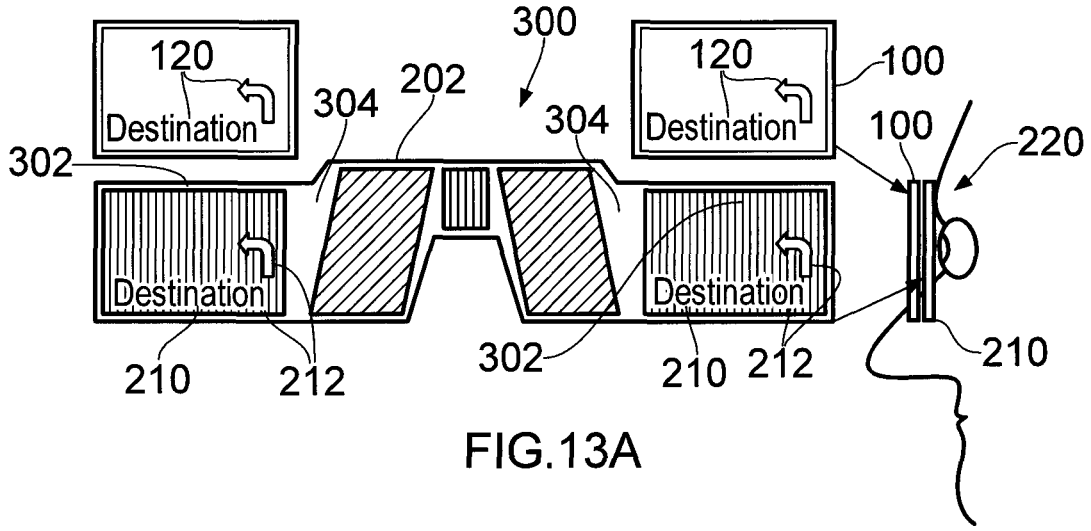
FIGS. 13A, 13B, 13C illustrate examples of using the display.

FIG. 13A illustrates an example of a near eye display 220 comprising a content display 210 and the apparatus 100 in different parallel layers.

The content display 210 may be provided by a combination of light guide 304 and output coupling element 302. The display 10 may be a liquid crystal display. A chassis 202 supports both the content display 210 and the apparatus 100 comprising the display 10.

The near eye display 220 is an example of a system 300 comprising the apparatus 100 and a chassis 202 configured to support the apparatus 100 in use. The system 300 is a wearable display 10 and the chassis is a wearable chassis configured to enable the apparatus 100 to be worn by a user.

Figure 13B:
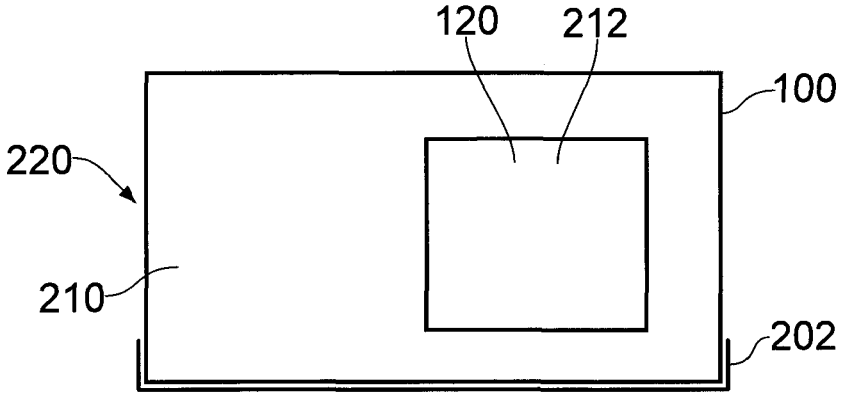

FIG. 13B illustrates an example of a dual mode display that can operate as a transparent window only and can operate as a transparent window with displayed content. The dual mode display 220 comprises a content display 210 and the apparatus 100 in different parallel layers.

The content display 210 may be provided by an emissive display such as an organic light emitting diode display. The display 10 may be a liquid crystal display. A chassis 202 supports both the content display 210 and the apparatus 100 comprising the display 10.

The dual mode display 220 is an example of a system 300 comprising the apparatus 100 and a chassis 202 configured to support at least the apparatus 100 in use.

The system 300 can be configured as an appliance and the chassis is an appliance chassis configured to enable the apparatus 100 to be part of the appliance. The dual mode display may, for example, be a window in a door of the appliance or a wall of the appliance, such as a fridge.

The system 300 can be configured as a building and the chassis is a building chassis configured to enable the apparatus 100 to be part of the building. The dual mode display may, for example, be an internal or external window in a door or wall of the building.

The system can be configured as a free-standing display 10 and the chassis is a support chassis configured to enable the apparatus 100 to be supported by the ground or other surface. The dual mode display may, for example, be a television. monitor, sign board. In these examples, the content display 210 can be but is not necessarily see-through. The mask 120 may be used to display intense spatially-consistent black.

Figure 13C:
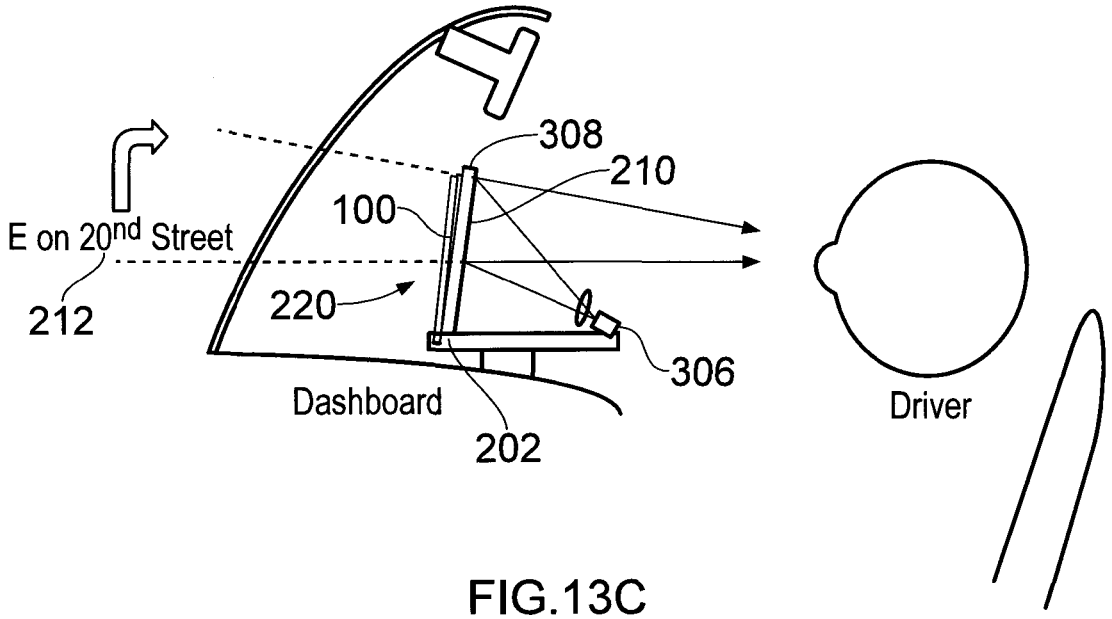

FIG. 13C illustrates an example of a heads-up display 220 comprising a content display 210 and the apparatus 100 in different parallel layers.

The content display 210 may be provided by projection of light from a light source 306 onto a screen 308. The display 10 may be a liquid crystal display. A chassis 202 supports both the content display 210 and the apparatus 100 comprising the display 10.

The heads-up display 220 is an example of a system comprising the apparatus 100 and a chassis 202 configured to support the apparatus 100 in use. The system 300 is a vehicle and the chassis 202 is a vehicular chassis configured to enable the apparatus 100 to be part of the vehicle. the vehicle may be, for example, an automobile or other land craft, a boat or other water craft or an aeroplane or other aircraft, a spaceship or other space craft, a submarine or other submersible craft.

It will be appreciated that the foregoing description describes some examples of an apparatus 100 comprising: a see-through display 10 comprising a plurality of pixels wherein a transparency state of a pixel 12 is controlled by a state of an associated cell 22 controllable via addressing and received cell-to-cell propagation signals 30. In some examples, each associated cell 22 is configured to have a first state that causes an opaque state 14A of one or more pixels 12 only if the state of that cell 22 is controlled via addressing to be the first state or a defined combination of adjacent cells 22 to that cell 22 all have a first state.

It will be appreciated that the foregoing description describes some examples of a method 170 comprising: at block 171, controlling a state of a first set of cells by addressing those cells 22 and controlling a state of a second set of cells 22 by cell-to-cell transfer of propagation signals 30; and at block 172, using the state of the first set of cells and the second set of cells to control a state of pixels 12 in a see-through display 10. FIG. 5 illustrates that in some examples, each cell is configured to have a first state that causes an opaque state 14A of one or more pixels 12 only if the state of that cell is controlled via addressing to be the first state or a defined combination of adjacent cells to that cell all have a first state.

It will be appreciated that the foregoing description describes some examples of an apparatus 100 comprising means for: controlling a state of a first set of cells by addressing those cells; controlling a state of a second set of cells by cell-to-cell transfer of propagation signals; using the state of the first set of cells and the second set of cells to control a transparency state of pixels 12 in a see-through display.

It will be appreciated that the foregoing description describes some examples of an apparatus 100 comprising structural features including: addressing control means for controlling a state of a first set of cells by addressing those cells; propagation control means for controlling a state of a second set of cells by cell-to-cell transfer of propagation signals; transparency control means for using the state of the first set of cells and the second set of cells to control a transparency state of pixels 12 in a see-through display.

As used in this application, the term 'circuitry' refers to all of the following:

(a) hardware-only circuit implementations (such as implementations in only analog and/or digital circuitry) and (b) to combinations of circuits and software (and/or firmware), such as (as applicable): (i) to a combination of processor(s) or (ii) to portions of processor(s)/software (including digital signal processor(s)), software, and memory(ies) that work together to cause an apparatus, such as a mobile phone or server, to perform various functions and (c) to circuits, such as a microprocessor(s) or a portion of a microprocessor(s), that require software or firmware for operation, even if the software or firmware is not physically present.

This definition of 'circuitry' applies to all uses of this term in this application, including in any claims. As a further example, as used in this application, the term "circuitry" would also cover an implementation of merely a processor (or multiple processors) or portion of a processor and its (or their) accompanying software and/or firmware. The term "circuitry" would also cover, for example and if applicable to the particular claim element, a baseband integrated circuit or applications processor integrated circuit for a mobile phone or a similar integrated circuit in a server, a cellular network device, or other network device.

The illustration of a particular order does not necessarily imply that there is a required or preferred order and the order and arrangement may be varied. Furthermore, it may be possible for omissions.

Where a structural feature has been described, it may be replaced by means for performing one or more of the functions of the structural feature whether that function or those functions are explicitly or implicitly described.

As used here 'module' refers to a unit or apparatus that excludes certain parts/components that would be added by an end manufacturer or a user.

The term 'comprise' is used in this document with an inclusive not an exclusive meaning. That is any reference to X comprising Y indicates that X may comprise only one Y or may comprise more than one Y. If it is intended to use 'comprise' with an exclusive meaning then it will be made clear in the context by referring to "comprising only one . . . " or by using "consisting".

In this brief description, reference has been made to various examples. The description of features or functions in relation to an example indicates that those features or functions are present in that example. The use of the term 'example' or 'for example' or 'may' in the text denotes, whether explicitly stated or not, that such features or functions are present in at least the described example, whether described as an example or not, and that they can be, but are not necessarily, present in some of or all other examples. Thus 'example', 'for example' or 'may' refers to a particular instance in a class of examples. A property of the instance can be a property of only that instance or a property of the class or a property of a sub-class of the class that includes some but not all of the instances in the class. It is therefore implicitly disclosed that a feature described with reference to one example but not with reference to another example, can where possible be used in that other example but does not necessarily have to be used in that other example.

Although embodiments of the present invention have been described in the preceding paragraphs with reference to various examples, it should be appreciated that modifications to the examples given can be made without departing from the scope of the invention as claimed.

Features described in the preceding description may be used in combinations other than the combinations explicitly described.

Although functions have been described with reference to certain features, those functions may be performable by other features whether described or not.

Although features have been described with reference to certain embodiments, those features may also be present in other embodiments whether described or not.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

We claim:

1. An apparatus comprising:

a see-through display, wherein the see-through display is configured to display content on the see-through display, wherein a scene is visible through the see-through display;

a transparency controlled display comprising a plurality of pixels; and control circuitry configured to selectively control transparency states of the plurality of pixels of the transparency controlled display, the control circuitry comprising a multiplicity of cells, wherein a transparency state of one or more of the plurality of pixels is controlled with a state of an associated cell, wherein the associated cell is configured to provide a propagation signal dependent upon the state of the associated cell to first physically adjacent cells and is configured to receive propagation signals provided from second physically adjacent cells, wherein the state of the associated cell is controllable via addressing and is controllable via the received propagation signals, wherein the transparency controlled display at least partially overlies the see-through display and is configured to selectively control see-through transparency in dependence upon the content displayed on the see-through display in front of the scene visible through the see-through display.

2. An apparatus as claimed in claim 1, wherein the control circuitry is configured such that, in response to a defined combination of adjacent cells to a subject cell having a first state, the subject cell has the first state, wherein the control circuitry is configured such that the first state of the subject cell causes an opaque state of the one or more pixels.

3. An apparatus as claimed in claim 1, wherein the control circuitry is configured such that, in response to any of a defined combination of adjacent cells to a subject cell having a second state and the state of the subject cell is not controlled via addressing to be a first state, the subject cell has the second state, wherein the control circuitry is configured such that the second state of the subject cell causes a transparent state of the one or more pixels.

4. An apparatus as claimed in claim 1, wherein the control circuitry is configured such that when a subject cell is controlled via addressing to be a first state, the subject cell causes an opaque state of the one or more pixels.

5. An apparatus as claimed in claim 1, wherein the multiplicity of cells are configured to provide respective propagation signals in electrical parallel.

6. An apparatus as claimed in claim 1, wherein a cell comprises circuitry for logically combining received propagation signals from different cells.

7. An apparatus as claimed in claim 1, wherein the multiplicity of cells are arranged in an array of rows and columns, wherein at least some of the multiplicity of cells comprise circuitry for logically combining a received propagation signal from a cell in a nearest neighbour row at a same column with a received propagation signal from a cell in a nearest neighbour column at a same row to provide an output propagation signal for a cell in a different nearest neighbour row and the same column and for a cell in a different nearest neighbour column and the same row.

8. An apparatus as claimed in claim 1, wherein a cell comprises a memory component configured to store a state of the cell for controlling the transparency state of the one or more pixels.

9. An apparatus as claimed in claim 7, wherein the control circuitry is configured to address the memory component to store a state of the cell.

10. An apparatus as claimed in claim 6, wherein the control circuitry is configured to address the memory component using a combination of a voltage state on a row line and a voltage state on a column line, wherein a first combination of high voltage and low voltage on the row line and the column line causes a first state to be written to the memory component, and a second different combination of high voltage and low voltage on the row line and the column line causes a second state to be written to the memory component.

11. An apparatus as claimed in claim 8, wherein the control circuitry is configured such that the stored value in the memory component is controllable via the received propagation signals.

12. An apparatus as claimed in claim 8, wherein the control circuitry is configured such that the stored value in the memory component determines the propagation signal provided to the physically adjacent cells.

13. An apparatus as claimed in claim 1, wherein the associated cell comprises a memory component configured to store the state of the associated cell for controlling the transparency state of the one or more pixels associated with the cell, wherein the control circuitry is configured to control a stored value of respective memory components of cells of a selected first set of cells and wherein the control circuitry is configured to apply the stored values of the respective memory components of at least the selected first set of cells to associated pixels, simultaneously in parallel.

14. An apparatus as claimed in claim 1, wherein the control circuitry is configured to define a boundary by setting a state of selected cells via addressing and is configured to in-fill the boundary via the propagation signals.

15. A system comprising the apparatus as claimed in claim 1, and a chassis configured to support the apparatus in use as part of the transparency controlled display, wherein the system is a wearable display and the chassis is a wearable chassis configured to enable the apparatus to be worn by a user, the system is a vehicle and the chassis is a vehicular chassis configured to enable the apparatus to be part of the vehicle, the system is an appliance and the chassis is an appliance chassis configured to enable the apparatus to be part of the appliance, the system is a building and the chassis is a building chassis configured to enable the apparatus to be part of the building, or the system is a free-standing display and the chassis is a support chassis configured to enable the apparatus to be supported by a ground.

16. An apparatus comprising:

a see-through display, wherein the see-through display is configured to display content on the see-through display, wherein a scene is visible through the see-through display; and a transparency controlled display comprising at least a plurality of pixels, wherein a transparency state of a pixel is controlled with a state of an associated cell controllable via addressing and received cell-to-cell propagation signals, wherein the plurality of associated cells are configured to have a first state that causes an opaque state of one or more pixels in response to the state of that cell being controlled via addressing to be the first state or a defined combination of adjacent cells to that cell having the first state, wherein the transparency controlled display at least partially overlies the see-through display and is configured to selectively control see-through transparency in dependence upon the content displayed on the see-through display in front of the scene visible through the see-through display.

17. A method comprising:

controlling a state of a first set of cells via addressing cells of the first set of cells;

controlling a state of a second set of cells with cell-to-cell transfer of propagation signals;

using the state of the first set of cells and the second set of cells to control a transparency state of pixels in a transparency controlled display, wherein the transparency controlled display at least partially overlies a see-through display, wherein the see-through display is configured to display content on the see-through display, wherein a scene is visible through the see-through display, and wherein the transparency controlled display is configured to selectively control see-through transparency in dependence upon the content displayed on the see-through display in front of the scene visible through the see-through display.

18. A method as claimed in claim 17, wherein the first set of cells is configured to have a first state that causes an opaque state of one or more pixels in response to the state of the first set of cells being controlled via addressing to be the first state or a defined combination of adjacent cells to cells of the first set of cells having the first state.

19. An apparatus as claimed in claim 1, wherein the content comprises virtual content.

* * * * *